United States Patent [19]

Brown

[11] Patent Number: 4,832,617

[45] Date of Patent: May 23, 1989

[54] CIRCUIT BOARD SOCKET, CONTACT AND METHOD OF MANUFACTURE

[75] Inventor: Richard Brown, Manitowish Waters, Wis.

[73] Assignee: Foxx Conn International, Inc., Santa Clara, Calif.

[21] Appl. No.: 175,766

[22] Filed: Mar. 31, 1988

[51] Int. Cl.[4] ..... H01R 13/62

[52] U.S. Cl. ..... 439/326

[58] Field of Search ..... 439/312, 326–328, 439/629–637

[56] References Cited

U.S. PATENT DOCUMENTS 3,771,100 11/1973 Reed .
3,848,952 11/1974 Tighe .
4,136,917 1/1979 Then et al. .
4,322,120 3/1982 Rilling .
4,370,012 6/1983 Grabbe et al. .
4,370,017 1/1983 Grabbe et al. .
4,486,061 12/1984 Grabbe et al. .
4,575,172 3/1986 Walse et al. ..... 439/326
4,713,013 12/1987 Regnier et al. .
4,718,859 1/1988 Gardner .
4,737,120 4/1988 Grabbe et al. ..... 439/326

*Primary Examiner*—Joseph H. McGlynn
*Attorney, Agent, or Firm*—Wood, Dalton, Phillips, Mason & Rowe

[57] ABSTRACT

A family of zero insertion force sockets for single and double sided circuit boards with a common stamped planar contact. The sockets are molded with common mold parts. The planar contact has a base with first and second spaced apart and generally parallel planar beam sections extending therefrom. The ends of the beam sections remote from the base are joined and form a contact surface.

9 Claims, 2 Drawing Sheets

FIG. 1
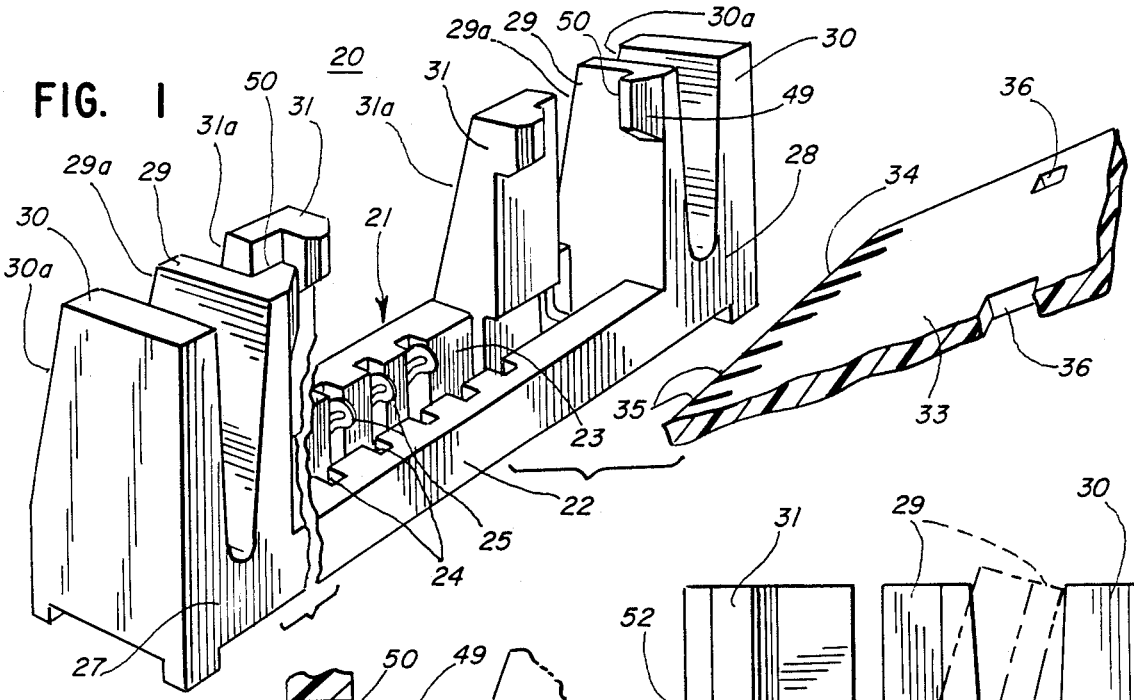
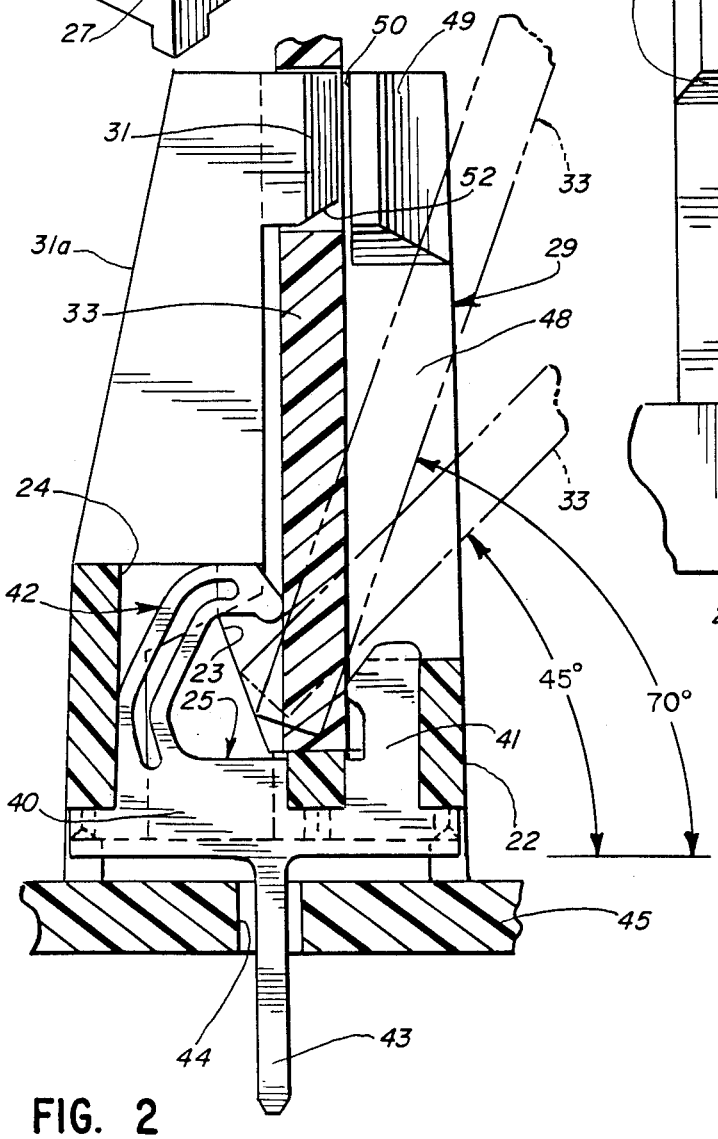
FIG. 2
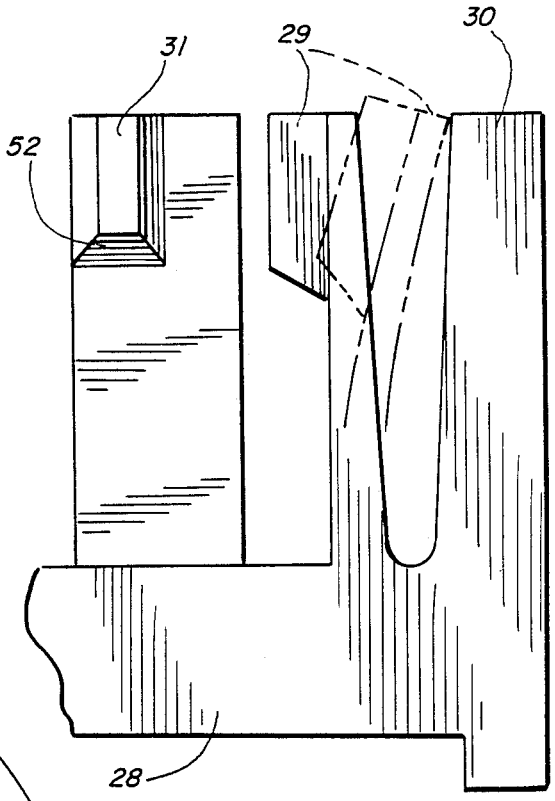
FIG. 3

CIRCUIT BOARD SOCKET, CONTACT AND METHOD OF MANUFACTURE

FIELD OF THE INVENTION

This invention relates to a circuit board edge connector socket, and more particularly a zero insertion force (ZIF) socket, a planar conductor beam contact and a method of socket manufacture in which a family of sockets are manufactured using the same contacts and mold parts.

BACKGROUND OF THE INVENTION

A circuit board typically has conductive areas which terminate at a series of positions spaced along an edge of the board for connection through a socket with other circuits. The conductive areas may be on one or both faces of the circuit board and if on both may be connected together (single sided) or electrically independent (double sided). A zero insertion force socket has contacts spaced to receive the circuit board edge with little or no interference so long as the circuit board is inserted at an appropriate angle. After insertion, the board is moved angularly to engage the socket contacts and mechanically latched in engaged position. The socket is typically mounted on a carrier, as another circuit board or a chassis. Several different configurations are common. In a straight or upright socket the latched circuit board is at right angles to the carrier. In a right angle socket, the latched circuit board is parallel with the carrier. In a low profile socket the latched circuit board extends upwardly from the carrier at an angle of the order of 25°. The length of the socket is determined by the number of circuits or conductive area positions on the board.

Circuit board sockets typically have a molded plastic housing in which the contacts are inserted following molding. Different molds are required for each style and size of socket. Contacts which have been used in the prior art have flexible sections subjected to high stress when flexed by rotation of the circuit board to the latched position. This results in contact breakage which requires replacement of the socket. Either the socket must be unsoldered, removed from the carrier and replaced or the entire carrier and the associated circuit elements replaced.

Examples of prior art ZIF sockets are found in Tighe 3,848,952, Then et al. 4,136,917, Regnier et al. 4,713,013 and Gardner 4,718,859.

BRIEF SUMMARY OF THE INVENTION

The socket housing, beam contact and methods of manufacture disclosed herein reduce problems of latch and contact breakage, simplify manufacturing by using common contacts and mold parts for different styles and sizes of socket and provide other advantages, as will appear.

One feature of the invention is that the socket housing which is of a molded plastic material has a stop to limit the movement of the releasable, flexible latch which holds the circuit board in a contact engagement position.

Another feature is that the socket housing has an identifying surface, as a face of the latch stop, for establishing socket orientation.

A further feature is that the contact for the socket accommodates a circuit board latched in either of two positions, having a leg with two fulcrum surfaces and a leg with two contact surfaces, one set of surfaces being engaged by the circuit board in one latched position and the other set of surfaces being engaged by the circuit board in the other latched position.

Yet another feature of the invention is that the flexible beam contact comprises a conductive member with a base and first and second generally parallel and spaced apart beam sections, the ends of the beam sections remote from the base being joined and an edge of the joined ends forming a contact surface so that movement of the joined ends stresses one of the beam sections in tension and the other in compression.

Still a further feature of the invention is the method of molding one of a family of circuit board socket housings, each housing having a central section for plural contacts to connect with circuit board conductors and end sections with a latch for retaining a circuit board and socket, comprising the steps of providing a plurality of mold central parts for different numbers of contacts, providing a plurality of sets of mold end parts to mate with a mold central part, each set of end parts having a different circuit board latch orientation, selecting a central mold part, selecting a set of mold end parts, combining the selected mold parts and molding the socket housing.

Another feature of the invention is the method of manufacture of a circuit board edge connector socket to mount on a carrier in one of a plurality of attitudes, which comprises providing a socket housing, providing contacts for the socket, each having plural terminal tails extending from the contact in diverse directions, removing from each contact the terminal tail or tails not needed, and assembling the contacts with the socket housing.

And a further feature of the invention is the provision of a contact with two contact surfaces and terminal tails and a severable base for manufacturing sockets for single and double sided circuit boards using the same components.

Other features and advantages of the invention will readily be apparent from the following specification and from the drawings, in which:

FIG. 1 is a broken perspective of a straight socket showing a portion of the edge of a circuit board to be inserted in the socket;

FIG. 2 is an enlarged section through a straight socket showing a circuit board in latched position, and illustrating in broken lines the range of angles through which the circuit board may be inserted;

FIG. 3 is a fragmentary elevation view of the end of a socket housing illustrating the circuit board latch, positioning boss and stop;

Figure 4:
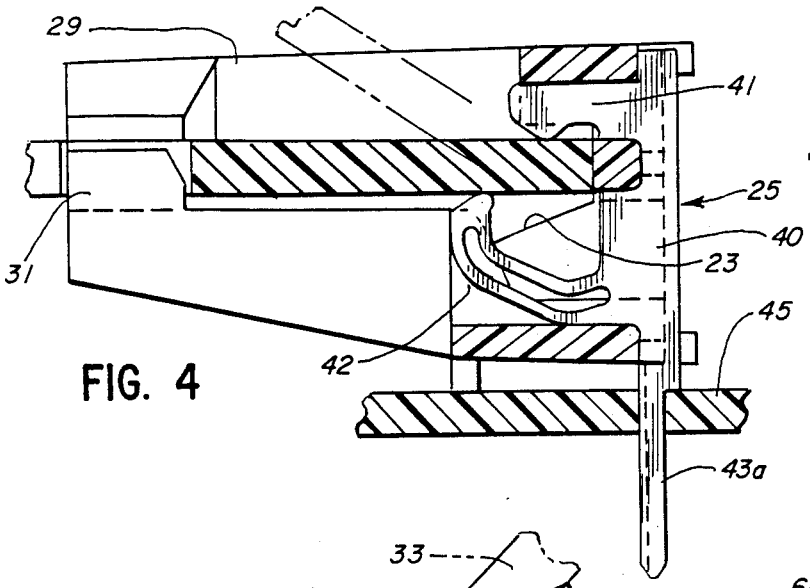
FIG. 4 is a section through a right angle socket with a circuit board shown in latched position and illustrating insertion of the board in broken lines.

The following detailed description is of a family of ZIF connector sockets and contacts therefor. Such sockets are the preferred embodiment of the invention.

Certain features of the disclosure have other uses and some of the claims are not limited to ZIF connector sockets.

The straight or upright configuration 20 of the ZIF socket is illustrated in FIG. 1. A housing 21, preferably of molded plastic, has a center section 22 with a longitudinally extending central recess 23 and lateral slots 24 in which contacts 25 are located. Complementary end sections 27, 28 each include a flexible circuit board latch 29, a latch stop 30 and a circuit board positioning boss 31.

A circuit board 33 has an edge 34 with discrete conductive circuit areas 35 in spaced positions along one or both sides of the edge of the board. A single sided board has a conductive area 35 at each conductor position either on one side of the board or if on both sides, electrically connected together. A double sided board has electrically separate conductive areas 35 on both sides of the circuit board. The edge 34 of the circuit board is inserted in the socket housing recess 23 with the board disposed at an angle as illustrated in FIG. 1. The contacts 25 receive the edge of the board with substantially no resistance, hence a zero insertion force socket. The circuit board is rotated angularly until it is engaged by latches 29. As will appear, the contacts 25 then engage the conductive circuit areas 35 completing electrical connections to the circuitry on board 33. Holes 36 in board 33 fit over the bosses 31, positioning the board in the socket. The latches 29 may be manually moved away from board 33, releasing the board. The board is rotated to disengage the conductive areas 35 from the contacts 25, permitting removal of the board from the socket.

The contact 25 is a stamped planar conductor, as 0.010 inch phosphor bronze. The contact has a base 40, a fulcrum leg 41 and a contact leg 42. A contact terminal tail 43 extends from the base 40 and is received in a hole through the carrier 45 on which socket 20 is mounted. Carrier 45 may be another circuit board, an equipment chassis or the like. Contact terminal tail 43 is connected with other circuitry as by soldering to a circuit on carrier 45, a wire wrap connection or the like. The space between the facing surfaces of fulcrum leg 41 and contact leg 42 is greater than the thickness of circuit board 33, nominally 0.050 inch.

The circuit board 33 may be inserted in the socket as shown in broken lines in FIG. 2 through a range of angles of the order of 45° to 70° with respect to carrier 45 without interference with the fulcrum or contact leg. The circuit board is then rotated in a counterclockwise direction as seen in FIG. 2 to an upright position in which it is accurately located by boss 31 and secured in the socket by latch 29.

The spacing between fulcrum leg 41 and contact leg 42 measured at right angles to the vertical plane of the latched circuit board is of the order of 0.041 inch with the contact leg undeflected, less than the nominal thickness of the circuit board. The fulcrum and contact legs 41, 42 engage the conductive areas 35 at the edge 34 of the circuit board completing electrical connections to the circuits on the board.

Latch 29 is a flexible leaf 48 molded integrally with the end section 28 of plastic housing 21. At the top of the leaf a cam surface 49 extends inwardly of the socket for engagement by the lateral edge of board 33 as the board is rotated to the upright position in FIG. 2. As the board passes the cam surface 49, locking surface 50 engages the board holding it in place. Bosses 31 enter the holes 36 in board 33 with a cam surface 52 on the lower edge of the boss causing the board to move downwardly into socket recess 23, locating the board in the socket. The circuit board is released by manually moving the latches outwardly, so that the surfaces 50 clear the edges of the board. This allows the board to be rotated clockwise to a position in which the edge is disengaged from contacts 25 and may be withdrawn from the socket. Stops 30 limit the outward movement of latches 29. This prevents breakage of the latches from excessive deflection during removal of a circuit board.

The housing 21, including the center section 22 and end sections 27, 28, each made up of a latch 29, stop 30 and board positioning boss 31, form an integral structure, preferably molded of plastic as will be discussed in more detail below. The contacts 25 are stamped, plated, trimmed or cut as will be described, and inserted in the housing slots 24.

As viewed in FIG. 1, the rear faces 29*a*, 30*a* and 31*a* of the latches, latch stops and positioning boss support, respectively, are formed at an angle to serve as identifying surfaces for establishing socket orientation in automatic handling apparatus, now shown. Such automatic handling apparatus may, for example, be used in positioning the housing for insertion of contacts 25 or for assembly of the socket on a carrier.

The right angle configuration of the socket is illustrated in FIG. 4. The housing 21 is the same as that of the straight socket shown in FIGS. 1–3. The contact 25 differs in that the terminal tail 43*a* extends laterally from the contact base 40. The socket is mounted on the carrier 45 as described above, but with the laterally extending terminal tail 43*a* projecting through the carrier for a suitable connection with a circuit. A circuit board 33 is inserted in the socket recess 23 at an angle of from 30°–45° with the horizontal carrier 45. Circuit board 33 is rotated counterclockwise to a latched position parallel with carrier 45 and is located and held in place by the boss 31 and latch 29, respectively.

Figure 5:
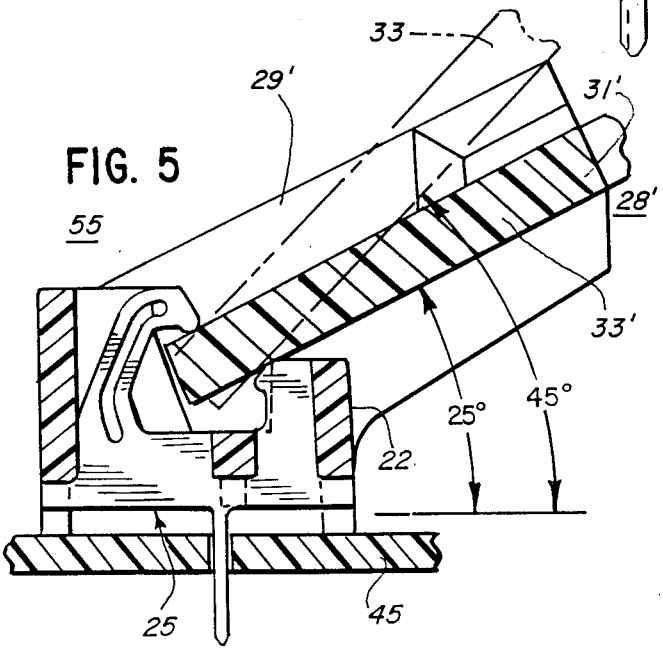
FIG. 5 is a section through a low profile socket with a circuit board shown in latched position and illustrating insertion of the board in broken lines.

A low profile configuration socket 55 is shown in FIG. 5. The socket center section 22 and the contact 25 are the same as in the straight socket of FIG. 2. The socket end section 28' extends at an angle of the order of 25° with respect to the carrier 45. Circuit board 33 is inserted in the socket at an angle in the range of 45°–70° with respect to the carrier 45 and rotated in a clockwise direction to the latched position of FIG. 5. The circuit board is positioned by boss 31' and retained in the socket by latch 29'. A stop behind latch 29' (not shown in FIG. 5) is preferably provided to prevent overflexing of the latch.

Figure 6:
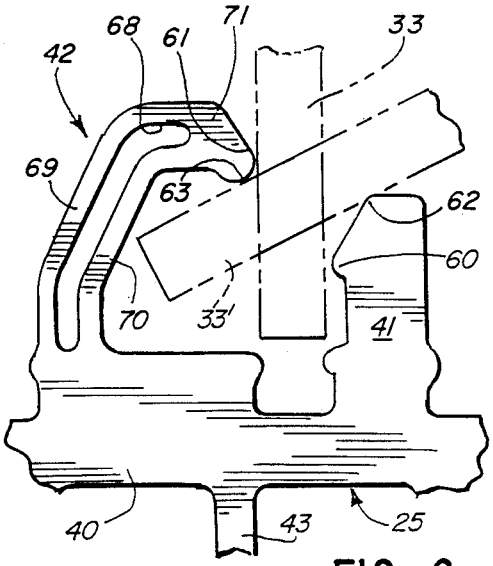
FIG. 6 is an enlarged elevation of the contact showing circuit boards in two positions.

The fulcrum leg 41 and the contact leg 42 of contact 25 have fulcrum and contact surfaces for engagement by the circuit board in both the straight (or right angle) and low profile socket configurations. This is illustrated in detail in FIG. 6 where the contact 25 is shown in an enlarged scale. The fulcrum leg 41 is short, wide and relatively rigid in the plane of the contact. The contact leg 42 is longer, arched above the fulcrum leg, and is relatively flexible in the plane of the contact. A circuit board 33 latched in the straight (or right angle) socket configuration engages the fulcrum leg 41 at a first fulcrum surface 60 and the contact leg at a first contact surface 61. The circuit board 33' latched in the low profile socket configuration engages the fulcrum leg at a second fulcrum surface 62 and the contact leg at a second contact surface 63. The first fulcrum and contact surfaces face each other and similarly the second fulcrum and contact surfaces 62, 63 face each other for engaging opposite sides of the edge of the circuit board.

Figure 7:
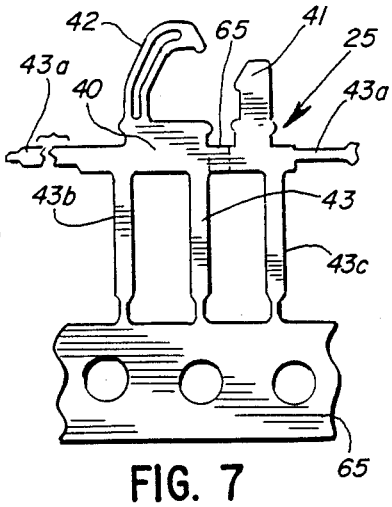
FIG. 7 is an elevation of a stamped planar contact on a carrier.

Planar contact 25 is preferably stamped from a strip of conductive material as shown in the fragmentary view of FIG. 7. A portion 65 of the strip provides a carrier for multiple contacts to facilitate handling during plating and other manufacturing procedures prior to assembly with a socket housing. Each contact 25 is initially provided with four terminal tails. Terminal tail 43 is centrally located of base 40 and extends at right angles thereto. Terminal tail 43*a* extends laterally from base 40, joining adjacent contacts. Terminal tails 43*b* and 43*c* extend from either end of base 40, parallel with terminal tail 43, providing additional support for the contact on the carrier strip 65.

The sockets of FIGS. 2 and 5 are shown with contacts having the terminal tail 43. The remaining terminal tails are cut away prior to assembly of the contact with the socket housing. If the lateral spacing of the contacts 25 is such that it is impractical to make connections to side-by-side terminal tails 43, terminal tails 43*b* and 43*c* can be used for alternate contacts with the remaining terminal tails cut away. In the right angle socket configuration of FIG. 4, terminal tail 43*a* is used and the remaining terminal tails are cut away.

Contacts in the straight and low profile socket configurations can accommodate different electrical circuits on opposite sides of a double sided circuit board 33. The contact base 40 is severed as indicated at 65 by broken lines, FIG. 7. Terminal tails 43 and 43*a* are removed. Connection is made to contact 41 through terminal tail 43*c* and to contact 42 through terminal tail 43*b*.

Flexible beam contact 42 is stamped with a central cutout 68 leaving first and second parallel and spaced apart planar beam sections 69, 70 which are fixed at the contact base 40. The ends of the beam sections remote from the base are joined at 71. The beam sections 69, 70 have substantially uniform width throughout their lengths and are preferably of the same width. The cutout space between the adjacent edges of the two beam sections has a width substantially the same as the width of the beam sections.

Deflection of the contact 42 by circuit board 33 in a straight or right angle socket configuration or by circuit board 33' in a low profile socket configuration stress beam section 69 in compression and beam section 70 in tension. The neutral axis of the contact 42 lies between the beam sections 69, 70, in the cutout area 68. The split beam configuration has a lower level of stress than a solid contact subjected to the same deflection, minimizing the risk of contact failure.

Figure 8:
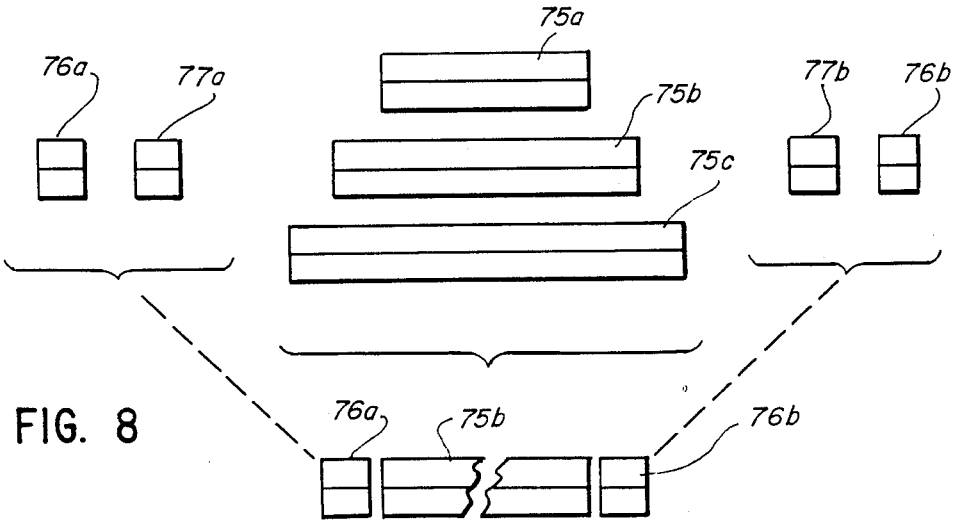
FIG. 8 is a diagram illustrating the method of molding housings.

Efficiency in the manufacture of the socket housings is achieved by using the molding method illustrated diagrammatically in FIG. 8. The socket housing central section 22 is common to the two socket configurations but has a length and contact capacity to match the circuit board. A plurality of mold central parts 75*a*, 75*b* and 75*c* are provided, each of a different length and each having a different number of contact slots. Two configurations of housing end sections 27, 28 for the straight and right angle sockets and 28' for the low profile socket are required. Two sets of mold end parts 76*a*, 76*b* and 77*a*, 77*b* are provided. Mold end parts 76*a*, 76*b* may be used in molding the end sections 27, 28 for the straight and right angle socket while mold end parts 77*a*, 77*b* may be used for molding the low profile end parts exemplified at 28', FIG. 5. In molding a particular socket housing, one of the central mold parts is selected to mold a central socket housing section with a desired contact capacity. A set of mold end parts is selected to mold socket housing end sections for the desired circuit board orientation. The selected mold parts, e.g., 75*b* and 76*a*, 76*b* are combined forming a composite mold for the desired socket housing. The combined mold is then used in molding socket housings.

The molding method together with the contact 25 accommodating circuit boards latched in one of two different positions and having multiple terminal tails for a variety of socket configurations enable the manufacture of a diverse family of circuit board sockets with a minimum of tooling.

I claim:

1. In a zero insertion force circuit board socket having one or more contacts which receive the edge of the circuit board at a first angle with negligible force, the circuit board being movable angularly to a position in engagement with said contact(s) and a releasable, flexible latch to hold the circuit board in said engagement position, the improvement comprising:

a stop to limit movement of said latch upon release of the circuit board.

2. The circuit board socket of claim 1 in which the socket has a molded plastic housing, the latch is an integral flexible cantilevered arm extending from the housing with a retaining surface to hold the circuit board, said arm being movable manually away from the circuit board to release the circuit board, and said stop is an integral rigid plate adjacent the flexible latch arm limiting its movement away from the circuit board.

3. The circuit board socket of claim 2 in which said latch arm stop plate has unsymmetric faces providing an identifying surface for establishing socket orientation.

4. A contact for a zero insertion force circuit board socket, comprising:

a planar conductor having an elongated base with spaced ends;

a leg extending from one end of the base and having an end with two fulcrum surfaces;

a leg extending from the other end of the base and having an end with two contact surfaces, the fulcrum surfaces facing the contact surfaces, the first and second fulcrum surfaces being spaced from the first and second contact surfaces, respectively, a distance greater than the thickness of the circuit board to receive the edge of a circuit board at a first angular attitude, the circuit board being movable angularly to each of two connecting positions by rotation about one of said two fulcrum surfaces, in each connecting position one side of the edge of said circuit board engaging one of said fulcrum surfaces and the other side of the edge of the circuit board engaging the corresponding contact surface, to maintain pressure between both legs and the edge of the circuit board.

5. In a zero insertion force circuit board socket having a circuit board latch, a contact for an upright or low profile socket configuration, comprising:

a base section having opposite ends;

an upstanding contact leg at one end;

an upstanding fulcrum leg at the other end, the contact and fulcrum legs being spaced apart to receive the edge of a circuit board therebetween, the circuit board edge being received with negligible force throughout a range of angular positions of the circuit board, the circuit board being movable in one angular direction to a latched position in a straight socket and in the opposite angular direction to a latched position in a low profile socket, the contact leg having first and second contact surfaces for engagement with the latched circuit board in straight and low profile sockets, respectively, and the fulcrum leg having first and second fulcrum surfaces for engagement with a latched circuit board in straight and low profile sockets, respectively.

6. The contact of claim 5 in which the first contact surfaces of the contact and fulcrum legs face each other and the second contact surfaces of the contact and fulcrum legs face each other.

7. The contact of claim 5 in which the contact leg is flexible and the fulcrum leg is rigid.

8. The contact of claim 5 in which the contact leg is arched and extends over the top of the fulcrum leg.

9. The contact of claim 8 in which the first contact surfaces are on inner lateral edges of the legs and the second contact surface of the contact leg is on an underedge of the arched contact leg and the second contact surface of the fulcrum leg is on the top surface of the fulcrum leg.

* * * * *